United States Patent [19]

Krusche

[11] 4,328,899

[45] May 11, 1982

[54] CROCKERY AND GLASSWARE STAND

[76] Inventor: Kurt Krusche, Nansenring 22, 6000 Frankfurt, Fed. Rep. of Germany

[21] Appl. No.: 146,435

[22] Filed: May 5, 1980

[30] Foreign Application Priority Data

Apr. 1, 1980 [DE] Fed. Rep. of Germany ... 8008973[U]

[51] Int. Cl.[3] ..... A47G 19/08; A47F 7/00; A47F 5/10

[52] U.S. Cl. ..... 211/41; 211/200; D6/190; D32/55

[58] Field of Search ..... 211/41, 40, 195, 200, 211/13, 14; D7/188; D6/190

[56] References Cited

U.S. PATENT DOCUMENTS

| | | | |
|---|---|---|---|
| 222,542 | 12/1879 | Stearn | 211/200 |
| D. 247,416 | 3/1978 | Berman et al. | D7/188 |
| D. 252,251 | 7/1979 | Lundahi | D7/188 |
| 2,005,939 | 6/1935 | Hibbard | 211/14 |
| 4,212,400 | 7/1980 | Buchsteiner | 211/41 |
| 4,221,299 | 9/1980 | Taylor | 211/41 |

*Primary Examiner*—Reinaldo P. Machado

*Attorney, Agent, or Firm*—Fidelman, Wolffe & Waldron

[57] ABSTRACT

A crockery and glassware stand (a dish and glassrack) for supporting plates and glassware after washing-up, comprises two generally rectangular identical frame parts hinged together about a longitudinal extending hinge or pivot axis so that they can be closed together or opened to form an X-shaped structure. Each frame portion above the hinge or pivot axis has parallel ribs extending vertically to the hinge axis and defining insertion slots for plates or the like, said insertion slots of the two frame parts being substantially in alignment. Each lower frame portion has end formations which are interconnected by a member having primary drainage openings and a supporting base at the lower margin disposed substantially perpendicularly to the interconnecting member and having undulations providing upwardly open recesses forming compartments for glassware. Each compartment is adapted to receive one glass or the like so that individual glassware items are kept separate from each other and held in a secure position without the risk of tipping out of the compartment.

6 Claims, 4 Drawing Figures

CROCKERY AND GLASSWARE STAND

BRIEF SUMMARY OF THE INVENTION AND PRIOR ART

The invention relates to a crockery and glassware stand, for example for supporting plates and glassware after washing-up, so as to allow them to drain and dry.

It has been proposed to provide a crockery and glassware stand comprising two generally rectangular identical frame parts which are hinged together about a longitudinally extending hinge axis, the frame parts having upper and lower portions extending above and below the hinge axis respectively in the manner of a scissors, so that they can be closed together or opened to form an X-shaped structure, each upper frame portion having parallel ribs or strips defining insertion slots for crockery, the ribs or strips being connected together near the hinge axis by struts extending parallel to the hinge axis, the insertion slots of the two frame parts being substantially in alignment, each lower frame portion having end formations which are interconnected by a member which is provided with primary drainage openings and which adjoins a supporting base portion of the frame part, said supporting base portion being disposed substantially perpendicularly to the interconnecting member.

One such previously proposed stand is made of wood and the said supporting base portions are hinged to the said interconnecting members. Another such previously proposed stand is made of plastics and the supporting base portions 11 are rigidly connected to the interconnecting members. In either case, the surfaces provided by the said base portions for supporting glassware are flat and in order to be stable the glassware must be laid lengthwise on the supporting surfaces provided by the base portions. It is difficult to avoid contact between adjacent glassware items, with the risk of damage to them.

It is an object of the invention to provide a crockery and glassware stand which enables a plurality of glassware items, even of different sizes, to be supported without mutual contact.

The invention consists in a crockery and glassware stand comprising two generally rectangular identical frame parts which are hinged together about a longitudinally extending hinge axis, the frame parts having upper and lower portions extending above and below the hinge axis respectively in the manner of a scissors, so that they can be closed together or opened to form an X-shaped structure, each upper frame portion having parallel ribs or strips defining insertion slots for crockery, the ribs or strips being connected together near the hinge axis by struts extending parallel to the hinge axis, the insertion slots of the two frame parts being substantially in alignement, each lower frame portion having end formations which are interconnected by a member which is provided with primary drainage openings and which adjoins a supporting base portion of the frame part, said supporting base portion being disposed substantially perpendicularly to the interconnecting member, said supporting base portion having undulations providing upwardly open recesses for receiving glassware or the like in such a way that individual glassware items are kept separate from each other.

Preferably, for each recess there is a projecting member arranged on the respective interconnecting member in such a way as to provide a detent gap relative to the surface defining the recess, the detent gap receiving a wall portion of a glassware item as an interference fit, whereby to provide additional security for said item. Advantageously, each projecting member is symmetrically centrally disposed relative to the corresponding recess.

For each recess, it is desirable that the respective interconnecting member has a secondary drainage opening which is positioned below the respective projecting member and which adjoins the surface defining the recess.

It will be appreciated that each recess forms a receptacle for a hollow body such as a cup or a glass, which is placed with its open end against the said interconnecting member and with its wall engaging or contacting the curved surface of the recess. A glass is thus supported both at its rim which contacts the said interconnecting member and at its body region which contacts the curved surface of the recess.

When the above mentioned projecting members are provided, they are only slightly spaced from the curved surfaces of the recesses, so that the detent gaps thus formed provide spaces for receiving rim regions of the glassware with the said projections and recess surfaces cooperating to gently grip the walls of the inserted glasses so as to securely retain them against accidental dislodgement.

BRIEF DESCRIPTION OF THE DRAWINGS

In order to make the invention clearly understood, reference will now be made to the accompanying drawings which are given by way of example and in which.

DETAILED DESCRIPTION OF THE DRAWINGS

Figure 1:
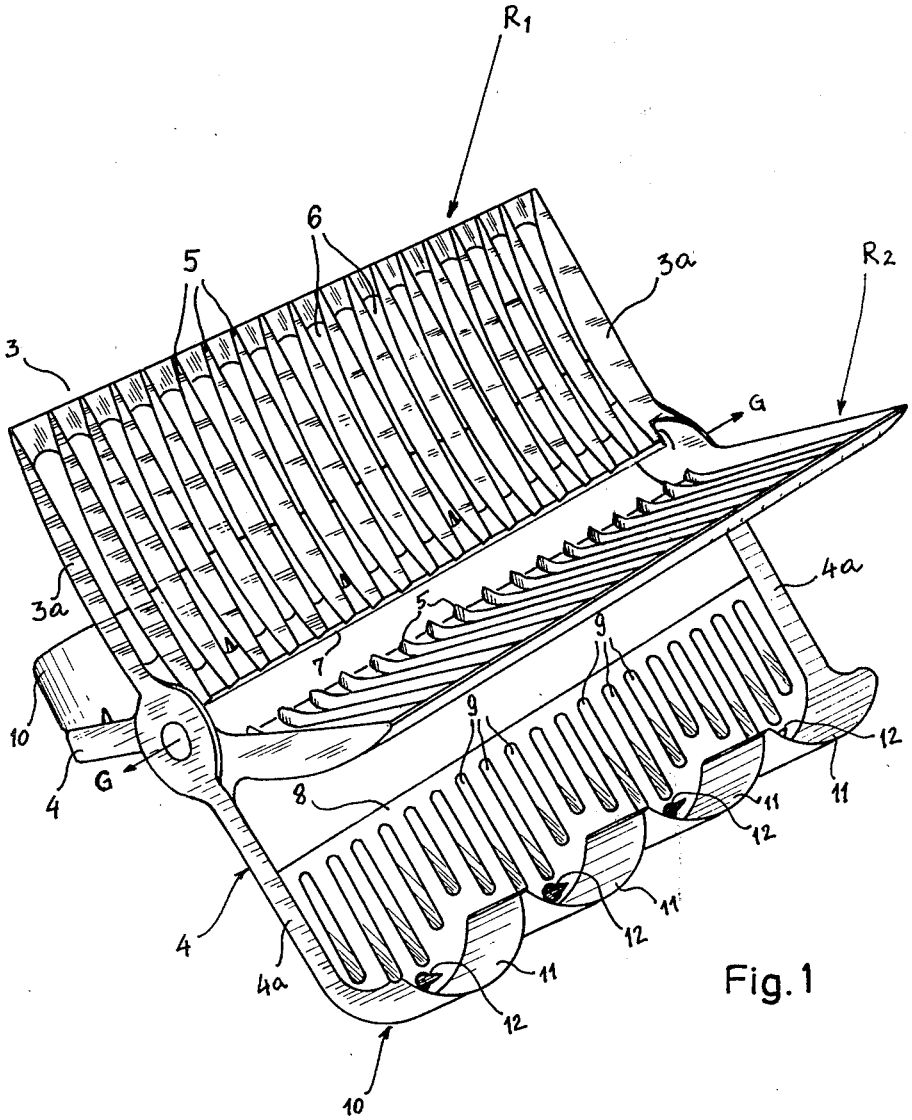
FIG. 1 is a perspective view of a crockery and glassware stand of the invention, in an opened, ready for use, condition.
Figure 4:
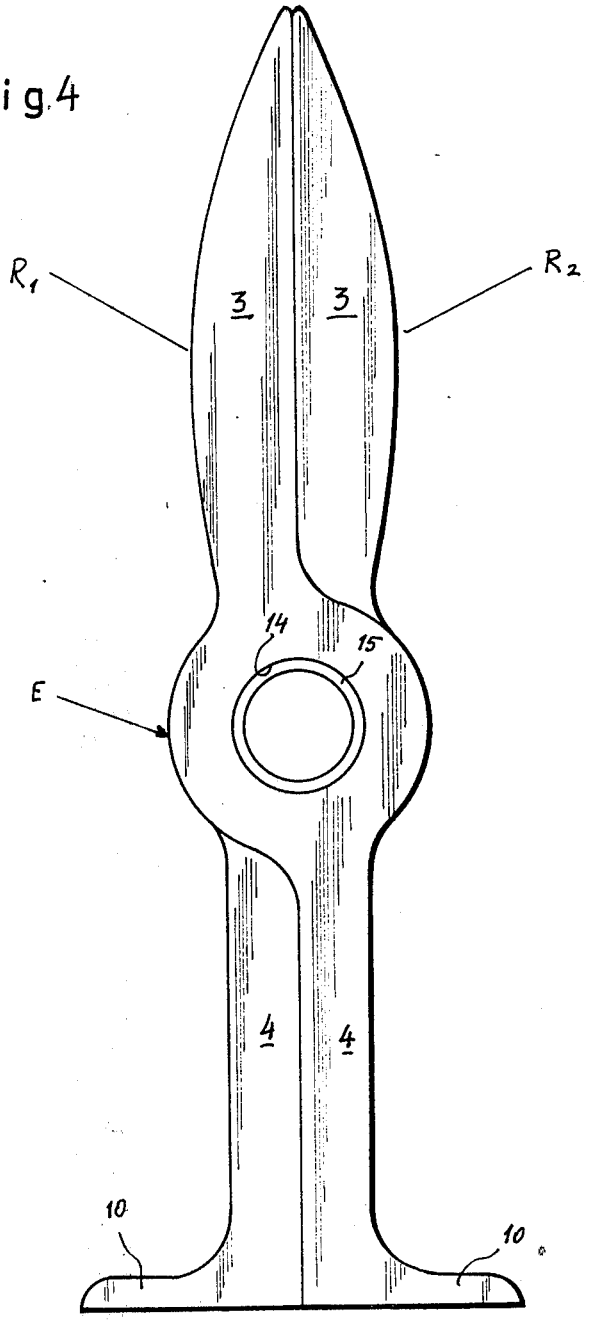
FIG. 4 is an end view of the crockery and glassware stand in the closed condition.

The crockery and glassware stand comprises two identical frame parts R1 and R2 which are hinged together substantally centrally at a hinge axis G in the manner of a scissors so that they can be closed into the condition shown in FIG. 4, or opened into the condition shown in FIG. 1, thus forming an X-shaped structure.

Figure 2:
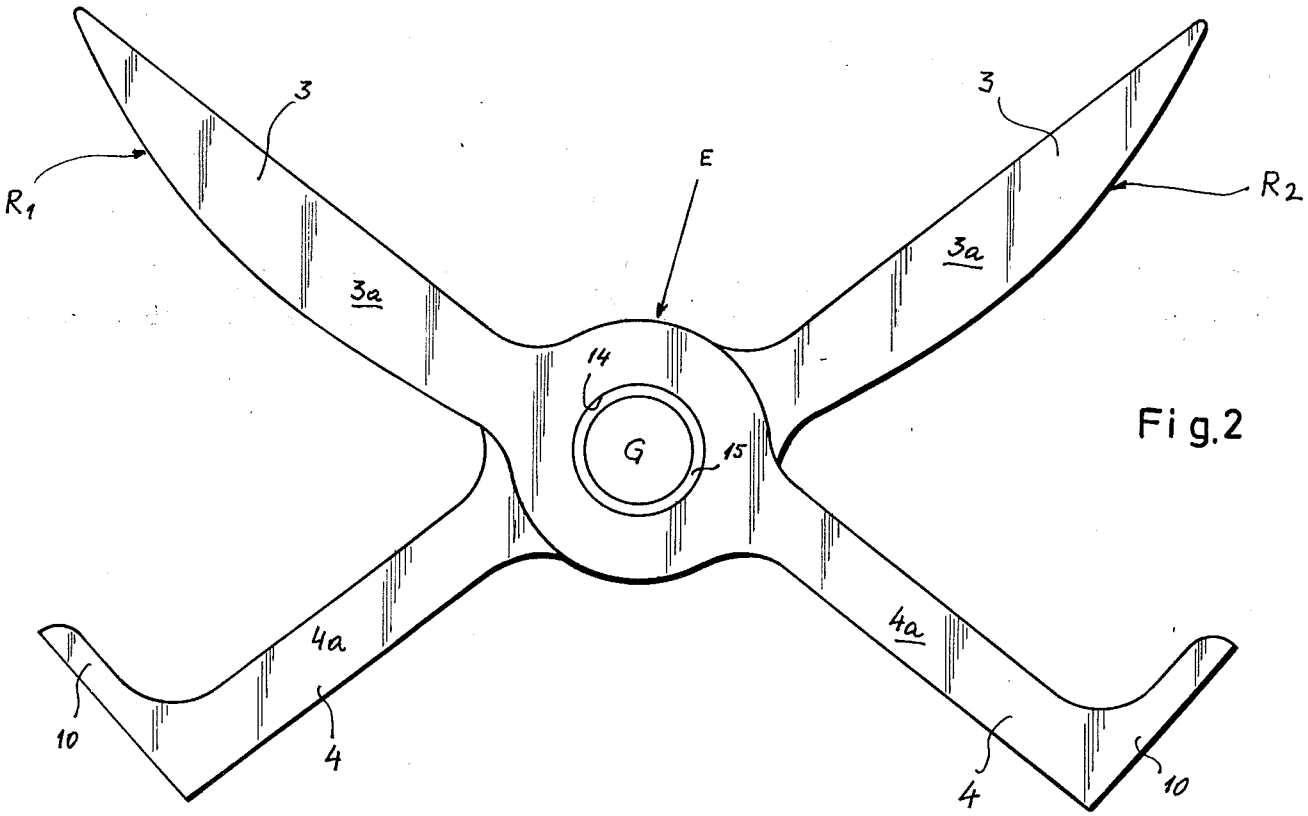
FIG. 2 is an end view of the crockery and glassware stand of FIG. 1.

The hinge axis G divides each frame part into an upper portion 3 above the hinge axis G and a lower portion 4 below the hinge axis G. As will be seen from FIG. 1, it is only the endmost sections of the frame parts that are continuous from the upper portion to the lower portion. Thus it will be seen that, at each end of the hinge axis each frame part has an end section formed by the portions 3*a* and 4*a*, the frame parts being hinged together by pivot structures 14, 15 (see FIG. 2) disposed at the transitions between the portions 3*a* and 4*a*.

As will be noted from FIG. 1, the lower portions 4 of the frame parts serve for supporting the entire device when it is in its open condition.

Since the frame parts R1 and R2 are identical, only the part R1 will be described. It will be seen that, between the end portions 3*a* of the frame part R1, there is a generally rectangular formation formed by an array of parallel ribs or strips 5 which define slots 6 between them. The ribs of strips 5 extend from a strut 7 which runs between the end portions 3*a*, parallel to the hinge axis G, the ribs or strips 5 being connected together at their outer ends by web-like formations. The ribs or strips 5 are so arranged that the slots 6 of one of the frame parts are aligned with the corresponding slots of the other frame part, as can be clearly seen from FIG. 3.

The slots 6 serve for receiving peripheral regions of plates and the like, so that plates can be supported and drained after washing-up.

Between the portions 4*a* of the end sections 4 of the frame part R1 (and similarly for frame part R2) an interconnecting member 8 extends, whch provides a supporting surface for glassware. The member 8 has slot shaped primary drainage openings 9 and is terminated at its lower extremity by a supporting wall 10 which is perpendicular to the plane of the said interconnecting member 8.

The wall 10 is of undulatory shape so as to provide a plurality of upwardly open trough shaped recesses 11. Each recess 11 serves for receiving a hollow body such as an item of glassware (not shown) the curved wall of the glass lying against the curved surface of the recess 11. The rim of the glass then lies in contact with the interconnecting member 8.

Figure 3:
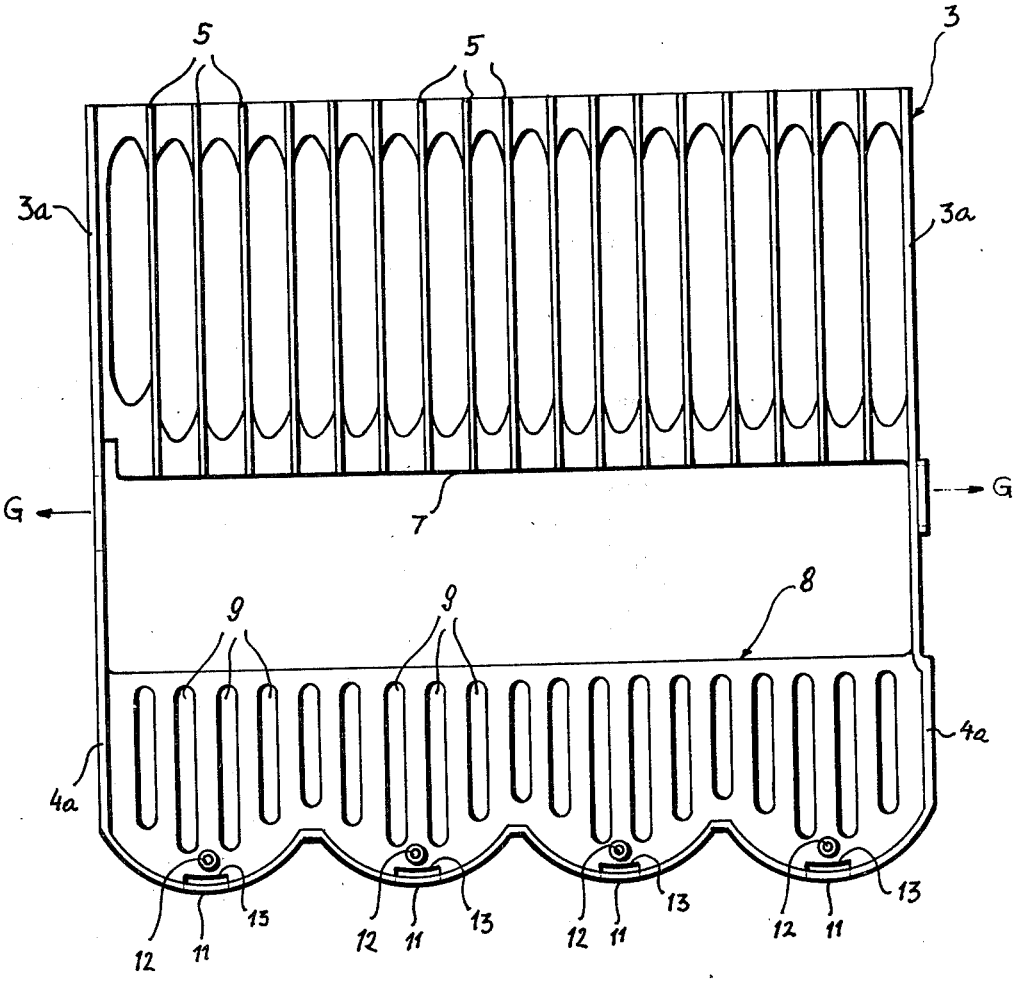
FIG. 3 is an elevation view of the crockery and glassware stand in a closed condition.

It will be appreciated that the member 8 and the curved surface of the recesses provide reliable support for glasses while at the same time ensuring that adjacent glasses do not abut against each other with the risk of damage. However, an additional provision is made, namely the provision of stud-like members 12 which project from the interconnecting member 8 close to the wall 10 and preferably symmetrically centrally disposed in relation to each recess 11 as shown in FIGS. 1 and 3.

The projecting members 12 define detent gaps with the surface of the recesses 11, the gaps being so dimensioned that the rims of glassware items can be received in them, with the said members 11 and the recess surfaces cooperating to gently grip the wall of the inserted glassware item. This gripping provision makes it practicable to place tall glassware items in the recesses without risk of the item tipping out of the recess.

In a preferred embodiment of the crockery and glassware stand, a secondary opening 13 (see FIG. 3) is provided at the lowest point of each recess 11, between the retaining member 12 and the recess surface. This promotes rapid and complete drainage of water from glassware items supported in the recesses 11.

Preferably, the crockery and glassware stand is made of plastics. The pivot connecting between the frame parts R1 and R2 may be by means of engagement of a stud or hub formation into a ring formation. At the pivot region, both frame parts are advantageously widened to form a circular pivot region. In the widened region E (see FIG. 4) of the frame part R1 there is a ring shaped cutout 14 in which a stud or hub member 15 is rotatably engaged, the stud or hub member 15 being arranged on or in the corresponding widened region of the frame part R2 and projecting therefrom into the cutout 14. The resilience of the plastics material makes such a construction of the frame parts R1 and R2 possible. Thus, a convenient and durable pivot structure can be achieved which is reliable and of pleasant appearance.

I claim:

1. A crockery and glassware stand comprising:

two generally identical cooperating rectangular frame parts hinged together at a hinge connection about a longitudinally extending axis and adapted to hinge between an open, generally X-shaped configuration position and a closed, generally parallel configuration position, each of said frame parts having upper and lower portions respectively extending above and below said axis, and first and second ends;

each of said upper frame portions having spaced parallel ribs connected together near said hinge axis by struts extending generally parallel to said axis to provide insertion slots for crockery, said frame parts adapted to support crockery in cooperating, generally aligned insertion slots when in said open position;

each of said lower frame portions having end formations and an interconnecting means for joining said end formations, said interconnecting means having primary drainage hols therein, and a supporting base portion connected to said end formations and said interconnecting member and extending substantially perpendicuarly out from said interconnecting members, said base portion having undulations adated to provide generally upwardly opening recesses for receiving and separating individual glassware items.

2. An apparatus as in claim 1, wherein each of said interconnecting members includes at least one projecting member extending outwardly into at least one of said recesses to provide a detent gap between said projecting member and said base portion, said detent gap adapted to provide an interference fit for the lip of a glassware item inserted therein.

3. An apparatus as in claim 2, wherein said projecting member is symetrically, centrally disposed relative to a corresponding recess.

4. An apparatus as in claim 2, wherein said apparatus further comprises a secondary drainage opening positioned below said projecting member.

5. An apparatus as in claim 1, wherein said apparatus is composed of a plastic material.

6. An apparatus as in claim 1, wherein each of said frame parts further comprises a circular cutout at said first end, and a hub portion at said second end adapted to engage in said cutout to provide said hinge connection.

* * * * *